US010932560B2

(12) United States Patent
Leng

(10) Patent No.: US 10,932,560 B2
(45) Date of Patent: Mar. 2, 2021

(54) HOLLOW PANEL FURNITURE

(71) Applicant: NEW-TEC INTEGRATION (XIAMEN) CO., LTD., Fujian (CN)

(72) Inventor: Luhao Leng, Xiamen (CN)

(73) Assignee: NEW-TEC INTEGRATION (XIAMEN) CO., LTD., Xiamen Fujian (CN)

( * ) Notice: Subject to any disclaimer, the term of this patent is extended or adjusted under 35 U.S.C. 154(b) by 274 days.

(21) Appl. No.: 15/760,603

(22) PCT Filed: Sep. 13, 2016

(86) PCT No.: PCT/CN2016/098798
§ 371 (c)(1),
(2) Date: Aug. 28, 2018

(87) PCT Pub. No.: WO2017/045579
PCT Pub. Date: Mar. 23, 2017

(65) Prior Publication Data

US 2019/0021484 A1 Jan. 24, 2019

(30) Foreign Application Priority Data

Sep. 16, 2015 (CN) ..... 2015 2 0717029 U

(51) Int. Cl.
*A47B 13/08* (2006.01)
*A47B 96/20* (2006.01)

(52) U.S. Cl.
CPC ..... *A47B 13/083* (2013.01); *A47B 13/08* (2013.01); *A47B 96/205* (2013.01); *A47B 2200/001* (2013.01)

(58) Field of Classification Search
CPC ..... A47B 13/08; A47B 13/083; A47B 96/205; A47B 2200/001
See application file for complete search history.

(56) References Cited

U.S. PATENT DOCUMENTS 1,979,309 A 11/1934 Beiger
2,739,640 A 3/1956 Brinker et al.
2,846,283 A 8/1958 Pasewalk
(Continued)

FOREIGN PATENT DOCUMENTS

CN 2517302 Y * 10/2002
CN 2517302 Y 10/2002
(Continued)

OTHER PUBLICATIONS

CN-2517302-Y Machine Translation (Year: 2002).*
(Continued)

*Primary Examiner* — Travis M Figg
(74) *Attorney, Agent, or Firm* — Perkins Coie LLP; Kenneth H. Ohriner

(57) ABSTRACT

A hollow table top comprises a top plate and a bottom plate stacked together. The edge of the bottom surface of the table top is disposed with a metal frame. The edge of the top plate is disposed with a downwardly extending top plate side. The metal frame is disposed with a protruding portion in the horizontal direction extending out of the top plate side. The protruding portion protects the joint of the top plate and the bottom plate. The external edge of the table top has double-layer appearance.

21 Claims, 10 Drawing Sheets

(56) References Cited

U.S. PATENT DOCUMENTS

| | | | | |
|---|---|---|---|---|
| 3,115,108 | A | 12/1963 | Craddock et al. | |
| 3,439,634 | A * | 4/1969 | Bender | A47B 95/04 108/27 |
| 3,477,716 | A * | 11/1969 | Bender | A63D 15/06 473/32 |
| 3,676,279 | A | 7/1972 | Beaver | |
| 5,271,338 | A | 12/1993 | Bonham et al. | |
| 5,303,824 | A | 4/1994 | Kohn | |
| 5,335,605 | A | 8/1994 | Drabczyk | |
| 5,357,872 | A | 10/1994 | Wilmore | |
| 5,461,989 | A * | 10/1995 | Grandclement | A47B 1/08 108/153.1 |
| 5,497,597 | A | 3/1996 | Elzenbeck | |
| 5,606,755 | A | 3/1997 | Romein | |
| 5,694,865 | A | 12/1997 | Raab | |
| 5,732,637 | A | 3/1998 | Raab | |
| 5,752,091 | A | 5/1998 | Kai et al. | |
| 5,835,661 | A | 11/1998 | Tai et al. | |
| 5,868,081 | A | 2/1999 | Raab | |
| 5,947,037 | A * | 9/1999 | Hornberger | A47B 13/083 108/115 |
| 6,058,853 | A * | 5/2000 | Pinch | A47B 3/087 108/129 |
| 6,058,854 | A | 5/2000 | Tarnay et al. | |
| 6,371,034 | B1 | 4/2002 | Simpson et al. | |
| 6,666,152 | B2 | 12/2003 | Tsai | |
| 6,752,091 | B2 | 6/2004 | Glover et al. | |
| 6,817,662 | B2 | 11/2004 | Winter et al. | |
| 7,140,308 | B2 | 11/2006 | Tsai | |
| 7,475,643 | B2 | 1/2009 | Haney et al. | |
| 7,735,915 | B2 | 6/2010 | Nye et al. | |
| D668,483 | S | 10/2012 | Bennett | |
| 8,387,544 | B1 | 3/2013 | Lee | |
| 9,808,081 | B2 | 11/2017 | Leng | |
| 9,867,458 | B2 | 1/2018 | Leng | |
| 10,092,091 | B1 | 10/2018 | Wang et al. | |
| 10,206,497 | B2 | 2/2019 | Leng | |
| 2003/0183135 | A1 | 10/2003 | Tsai | |
| 2003/0200904 | A1 * | 10/2003 | Strong | A47B 13/021 108/125 |
| 2003/0213414 | A1 | 11/2003 | Strong | |
| 2003/0213416 | A1 | 11/2003 | Strong et al. | |
| 2003/0230219 | A1 * | 12/2003 | Strong | A47B 3/0912 108/27 |
| 2004/0187744 | A1 * | 9/2004 | Wang | A47B 13/083 108/27 |
| 2005/0274306 | A1 * | 12/2005 | Strong | A47B 13/08 108/115 |
| 2005/0284562 | A1 | 12/2005 | Frantz et al. | |
| 2008/0092788 | A1 * | 4/2008 | Leng | A47B 21/00 108/159 |
| 2008/0098936 | A1 | 5/2008 | Strong | |
| 2008/0264307 | A1 | 10/2008 | Vannimwegen et al. | |
| 2008/0265307 | A1 | 10/2008 | Lee | |
| 2009/0324872 | A1 * | 12/2009 | Leng | B32B 3/04 428/73 |
| 2010/0043681 | A1 * | 2/2010 | Leng | A47B 13/003 108/193 |
| 2010/0112265 | A1 | 5/2010 | Leng | |
| 2010/0310811 | A1 | 12/2010 | Leng | |
| 2011/0174197 | A1 | 7/2011 | Seger | |
| 2011/0203493 | A1 | 8/2011 | Ashby et al. | |
| 2013/0025508 | A1 * | 1/2013 | Leng | A47B 13/08 108/161 |
| 2014/0037910 | A1 | 2/2014 | Leng | |
| 2016/0051049 | A1 * | 2/2016 | Peery | A47B 87/02 108/91 |
| 2016/0066684 | A1 | 3/2016 | Leng et al. | |
| 2018/0064242 | A1 | 3/2018 | Tsai | |
| 2020/0022490 | A1 | 1/2020 | Leng | |
| 2020/0275780 | A1 | 9/2020 | Leng | |

FOREIGN PATENT DOCUMENTS

| | | | |
|---|---|---|---|
| CN | 2829461 | Y | 10/2006 |
| CN | 201299266 | Y | 9/2009 |
| CN | 202222701 | U | 5/2012 |
| CN | 103239011 | A | 8/2013 |
| CN | 103284471 | A | 9/2013 |
| CN | 205093820 | U | 3/2016 |
| CN | 207657291 | U | 7/2018 |
| JP | 2982712 | | 11/1999 |

OTHER PUBLICATIONS

Extended European Search Report dated Feb. 21, 2019 for Application No. 1685693.7, 6 pages.

State Intellectual Property Office, PRC China, International Search Report for International Application No. PCT/CN2016/098798 dated Oct. 28, 2016, 22 pages.

CNIPA, "International Search Report and Written Opinion", for PCT/CN2019/101382, dated Nov. 19, 2019, with English translation, 14 pgs.

* cited by examiner

HOLLOW PANEL FURNITURE

BACKGROUND OF THE INVENTION

A known plastic table top has a single thick plate or two layers of thin plates. These table tops are blow molding types and vacuum forming types. These hollow table tops have a top plate and a bottom plate stacked together. A metal frame is disposed at the inner side of the periphery of the stacked top plate and the bottom plate. Existing vacuum forming table tops need vertical flanges at the inner side of the periphery of the top and bottom plate to cover the metal frame. The joint of the top plate and the bottom plate is exposed. In use fingers or clothes may be caught or clamped by the vertical flanges, causing injury or damaging clothes or the vertical flanges. This kind of embedded metal frame only acts to increase strength and connect the support elements but it cannot protect the connecting points of the top plate and the bottom plate.

SUMMARY OF THE INVENTION

A frame structure of a table top with stable structure and high security overcomes the disadvantages of the related art.

A hollow table top has a top plate and a bottom plate, the bottom plate is disposed with projections or concave features. The edge of the bottom surface of the table top is disposed with a metal frame, the edge of the top plate extends downwardly. The metal frame is disposed with a protruding portions in the horizontal direction extending out of the top plate side.

In another preferred embodiment, the protruding portion of the metal frame is a crimping bending upwardly and covers the bottom portion of top plate side.

In another preferred embodiment, the protruding portion of the metal frame is closed to the bottom portion of the top plate side.

In another preferred embodiment, the bottom portion of the top plate side bends towards the metal frame. The side surface of the hollow table top is substantially a plane.

In another preferred embodiment, the edge of the bottom plate is disposed with a downwardly extending bottom plate side. The crimping covers the bottom portion of the bottom plate side.

In another preferred embodiment, the bottom portion of the bottom plate side bends towards the metal frame.

In another preferred embodiment, the bottom portion of the bottom plate is disposed with a downwardly extending fixing portion. The fixing portion is disposed at the side of the top plate side opposite to the metal frame. A screw laterally passes through the fixing portion to lock to the metal frame.

Compared to the existing known technology, advantages are:

1. The external side of the metal frame extends out of the top plate side, and covers the bottom portion of the top plate side or abuts against the bottom portion of the top plate side. When being used, the bottom portion of the top plate is not folded up, improving the integration of the table top. Fingers or clothes are not clamped by the vertical flange. At the same time, the crimping covers the top plate side.

2. The metal frame is detachably locked to the bottom plate, the structure is simple and more stable.

DETAILED DESCRIPTION OF THE EMBODIMENTS

The First Embodiment

Figure 1:
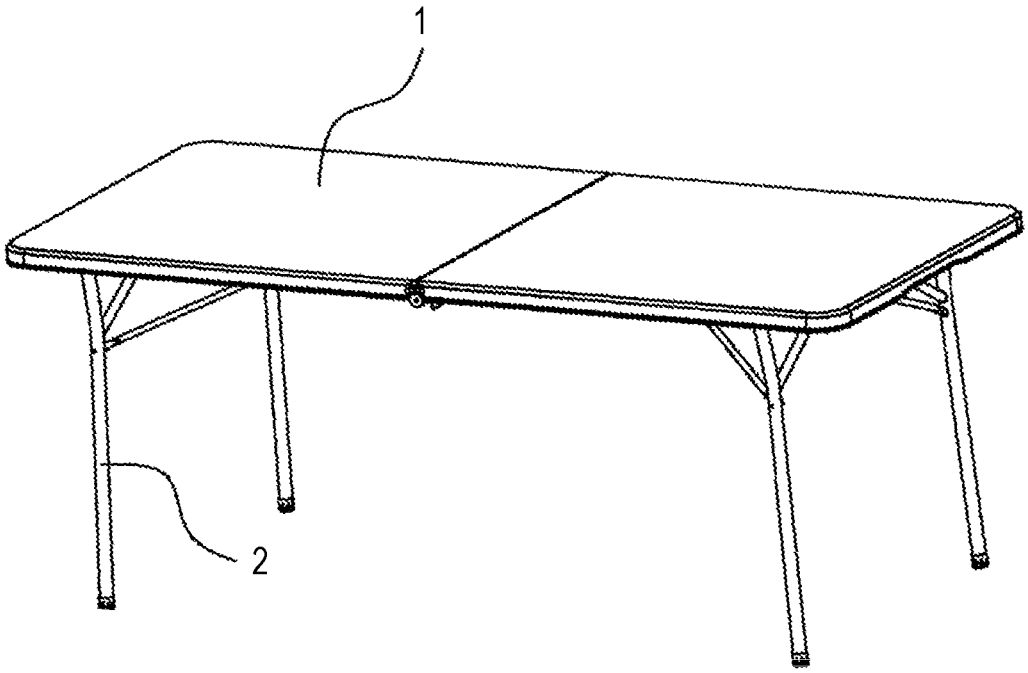
FIG. 1 illustrates a schematic diagram of a table.
Figure 2:
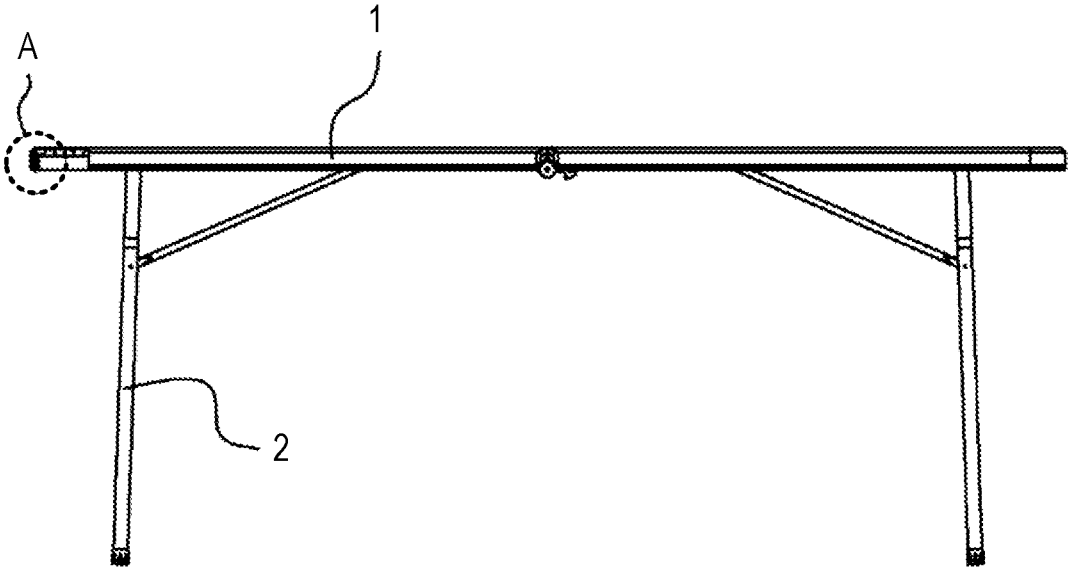
FIG. 2 illustrates a front view of the table of FIG. 1.
Figure 3:
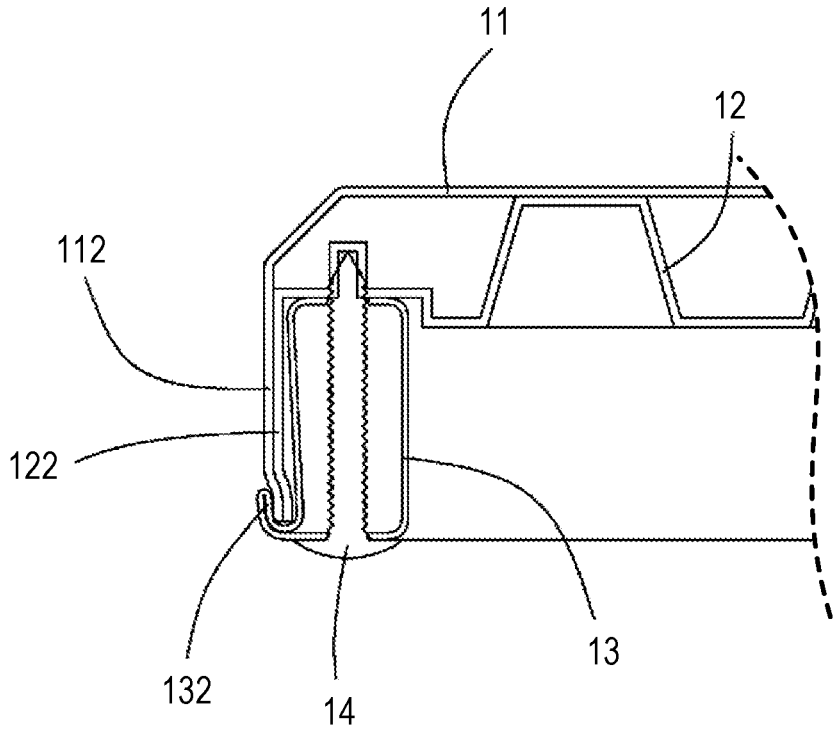
FIG. 3 illustrates an enlargement diagram of area A of FIG. 2.

Referring to FIG. 1, FIG. 2 and FIG. 3, the table comprises a table top 1 and table legs 2. The table legs 2 are foldable and connected to the bottom of the table top 1. The table top 1 comprises a top plate 11 and a bottom plate 12 being stackable together. The bottom plate 12 has concave features or projections 12.1. The edge of the bottom surface of the top plate 1 is disposed with a metal frame 13. The bottom plate 12 is supported on the metal frame 13. The metal frame 13 is detachably locked to the bottom plate 12. A screw 14 passes through the metal frame 13 to lock to the bottom plate 12 from end up.

The edge of the top plate 11 is disposed with a downwardly extending top plate side 112. The bottom portion of the top plate side 12 bends towards the metal frame 13. The edge of the bottom plate 12 is disposed with a downwardly extending bottom plate side 122. The bottom portion of the bottom plate side 122 bends towards the metal frame 13. The top plate side 112 and the bottom plate side 122 are contacted together. The metal frame 13 has a protruding portion, which, in this embodiment is a crimping 132 bending upwardly from the bottom portion of the top plate side 112. The crimping 132 covers the bottom portion of the top plate side 112 and the bottom plate side 122.

The bottom portion of the top plate side and the bottom plate side bend towards the metal frame so as to make space for the crimping and keep the crimping and the external edge of the crimping vertically aligned, so the side surface is in a plane and the table top attractive.

The Second Embodiment

Figure 4:
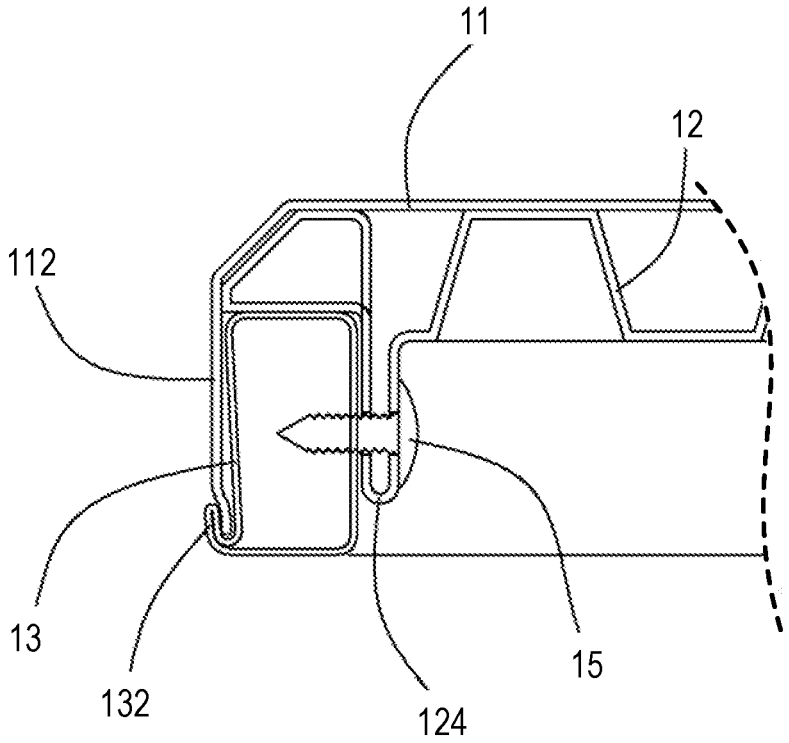
FIG. 4 illustrates a schematic diagram of a frame of another table top.

Referring to FIG. 4, the second embodiment differs from the first embodiment in that: the edge of the bottom plate 12 does not have a bottom plate side and the crimping 132 only covers the top plate side 112. The bottom portion of the bottom plate 12 extends down with a fixing portion 124, which is disposed at the side of the metal frame 13 opposite to the top plate side 112. A screw 15 laterally passes through the fixing portion 124 to lock to the metal frame 13.

The Third Embodiment

Figure 5:
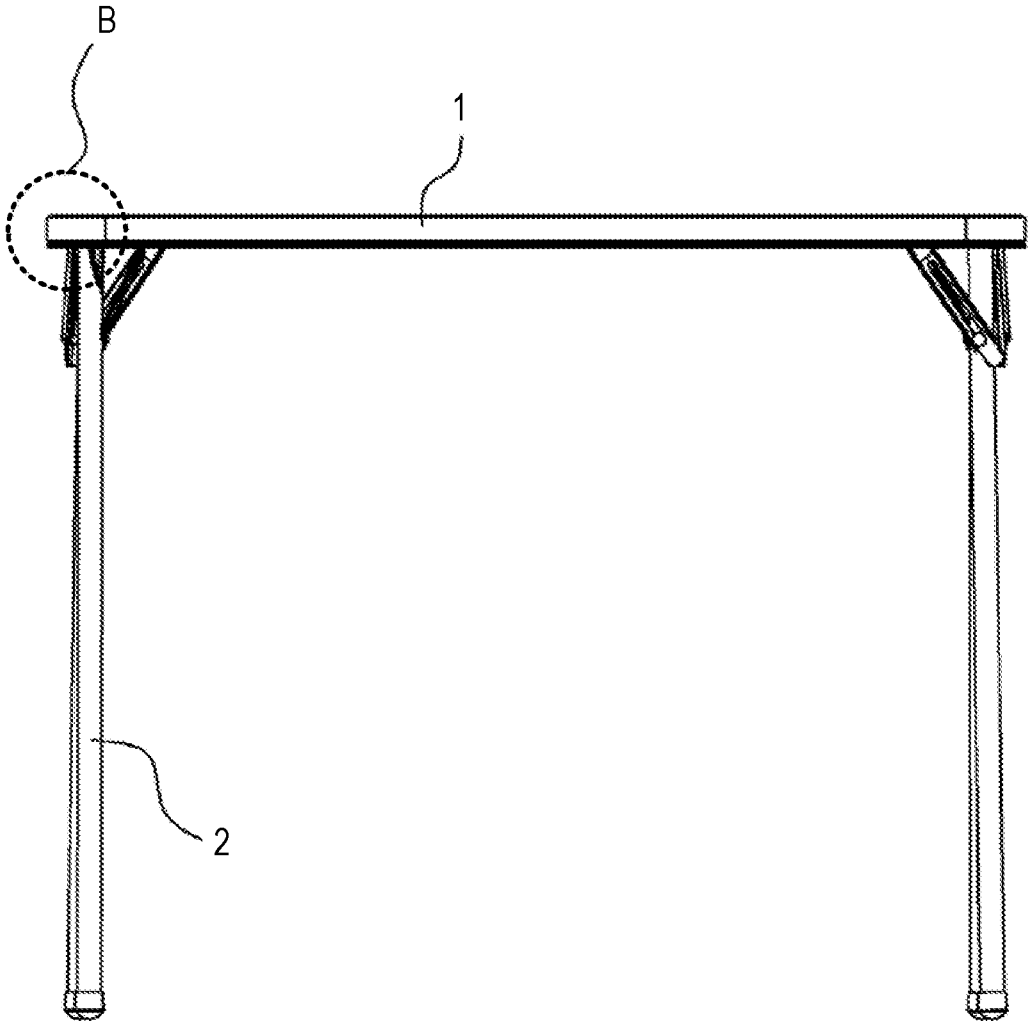
FIG. 5 illustrates a schematic diagram of a table of a third embodiment.
Figure 6:
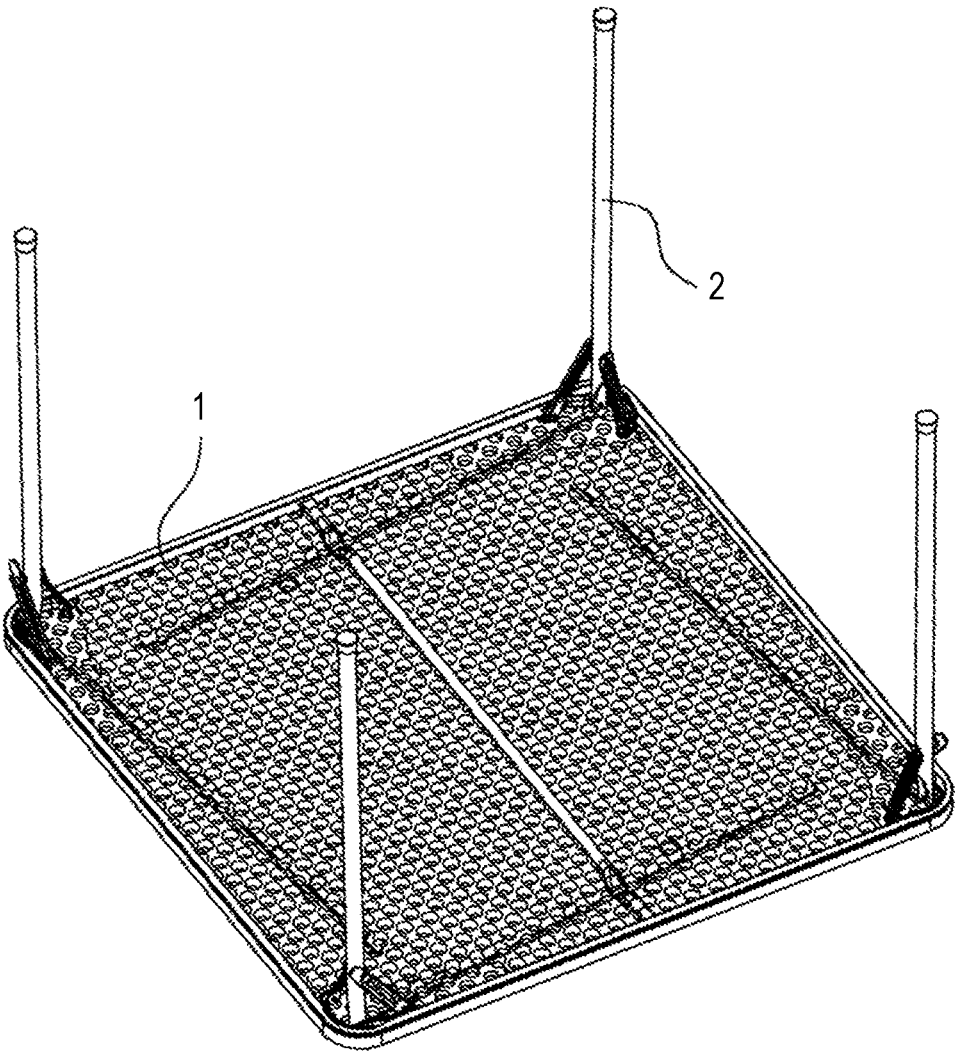
FIG. 6 illustrates a schematic diagram of the bottom portion of the table of the third embodiment.
Figure 7:
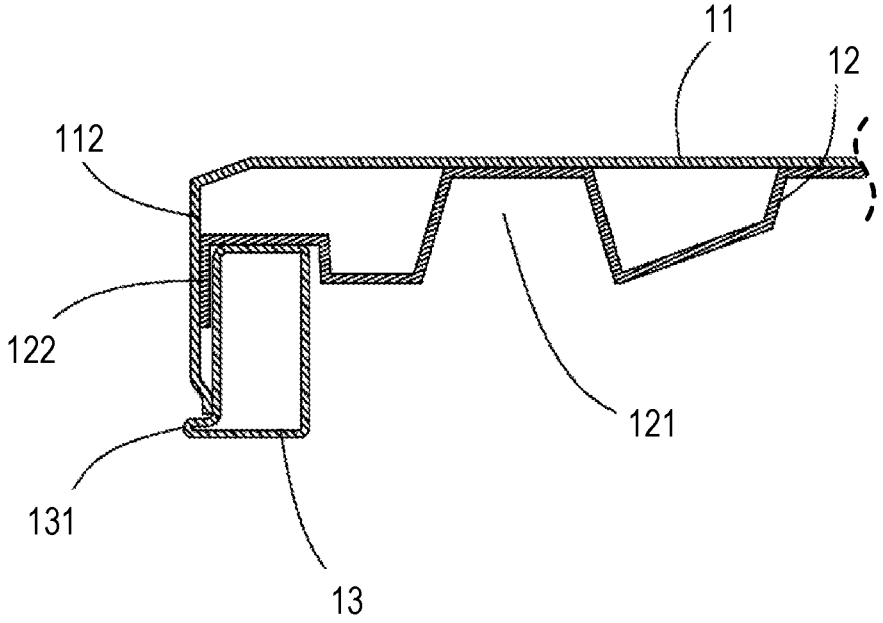
FIG. 7 illustrates an enlargement diagram of B of FIG. 5.

Referring to FIG. 5, FIG. 6 and FIG. 7, the table of this embodiment is a square table comprising a table top 1 and table legs 2. The table legs 2 are foldable and connected to the bottom portion of the table top 1. The table top 1 comprises a top plate 11 and a bottom plate 12 being stackable together. The bottom plate has projections or concave features 12.1. The edge of the bottom surface of the table top 1 is disposed with a metal frame 13, which supports on the bottom plate 12. The metal frame 13 is locked to the bottom plate 12. A screw 14 (not shown) passes through the metal frame 13 to lock to the bottom plate 12 from end up.

The edge of the top plate 11 is disposed with a downwardly extending top plate side 112. The edge of the bottom plate 12 is disposed with a downwardly extending bottom plate side 122. The top plate side 112 and the bottom plate side 122 are in contact and attached together. The metal frame 13 is disposed with a protruding portion 131, which is a substantially lateral straight edge at the bottom portion of the metal frame. The bottom portion of the top plate side 112 ends at the protruding portion 131 of the metal frame.

The Fourth Embodiment

Figure 8:
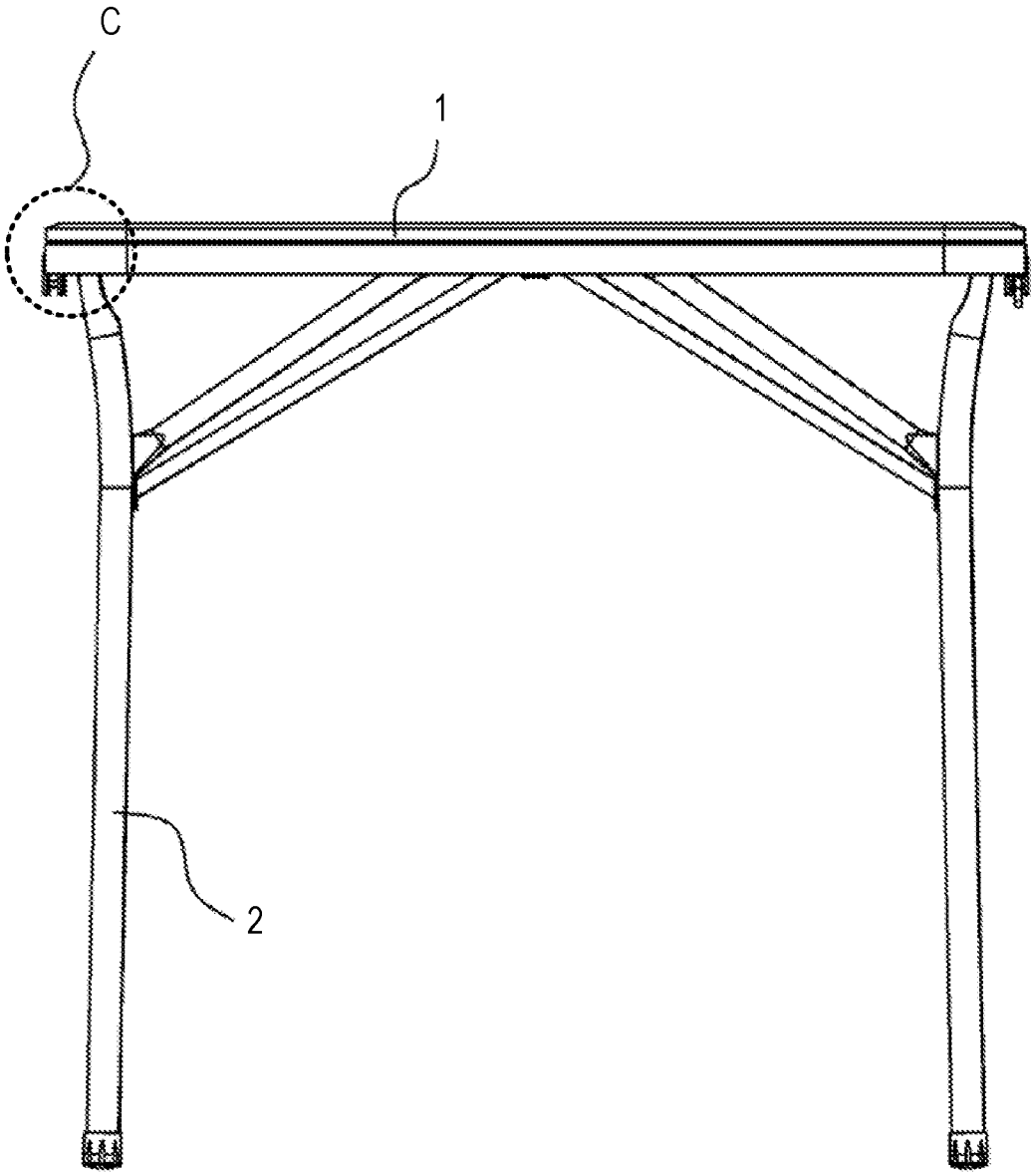
FIG. 8 illustrates a front view of a table of a fourth embodiment.
Figure 9:
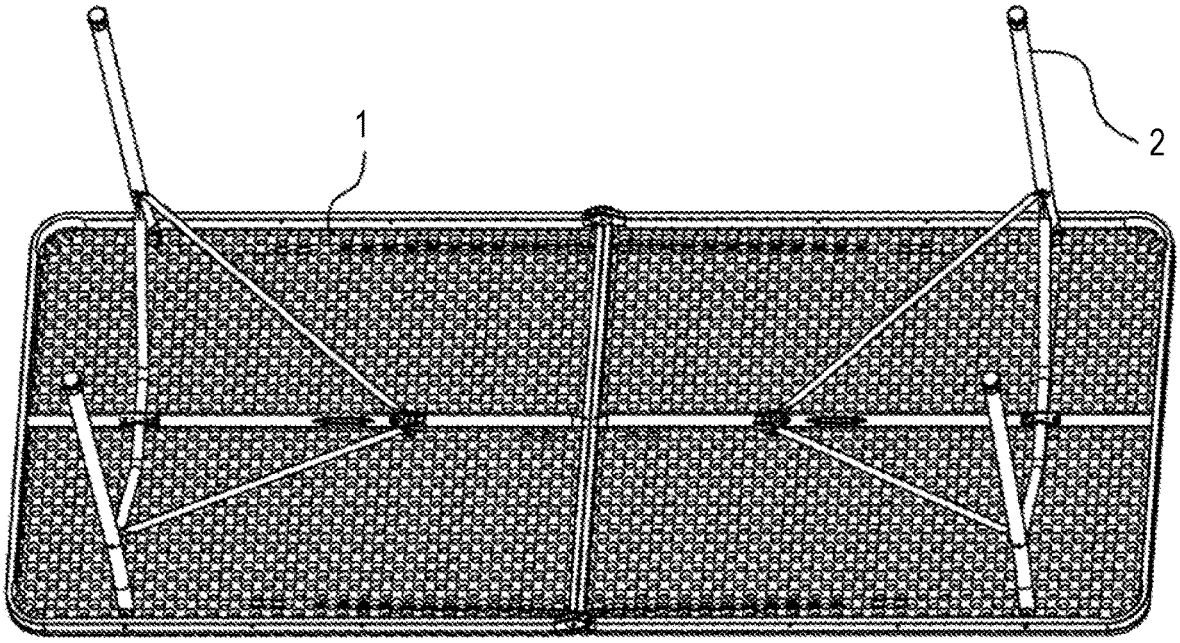
FIG. 9 illustrates a schematic diagram of the bottom portion of the fourth embodiment.
Figure 10:
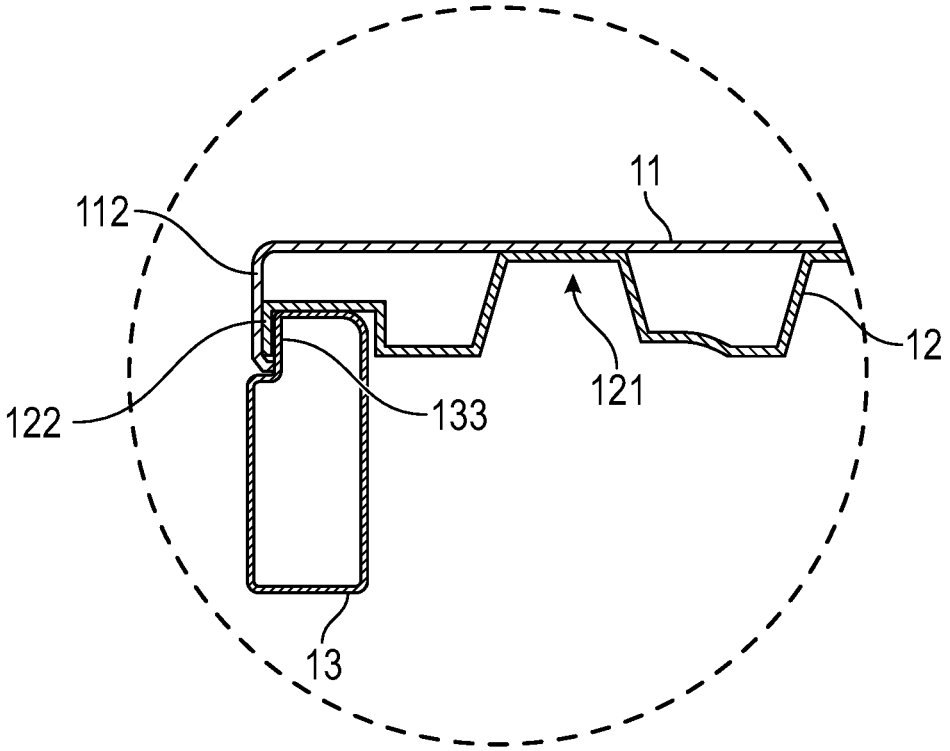
FIG. 10 illustrates an enlargement diagram of C of FIG. 8.

Referring to FIG. 8, FIG. 9 and FIG. 10, the table of this embodiment is a long table with a foldable table top, the table comprises a table top 1 and table legs 2. The table legs 2 are foldable and connected to the bottom portion of the table top 1. The table top 1 comprises a top plate 11 and a bottom plate 12 being stackable together. The bottom plate has projections or concave features 12.1. The edge of the bottom surface of the table top 1 is disposed with a metal frame 13, which supports on the bottom plate 12. The metal frame 13 is locked to the bottom plate 12.

The edge of the top plate 11 is disposed with a downwardly extending top plate side 112. The top plate side 112 and the bottom plate side 122 are in contact and attached together. The metal frame 13 is disposed with a protruding portion 133. The bottom portion of the top plate side 112 ends at the protruding portion 133 of the metal frame.

Although the present invention has been described with reference to the preferred embodiments thereof for carrying out the patent for invention, it is apparent to those skilled in the art that a variety of modifications and changes may be made without departing from the scope of the invention which is defined by the appended claims.

The invention claimed is:

1. Furniture comprising:

a top plate having a flat and horizontal inner section having four sides, and first, second, third and fourth vertical side plates along the four sides of the inner section of the top plate, respectively, the first, second, third and fourth vertical side plates perpendicular to the horizontal inner section of the top plate;

a bottom plate attached to the inner section of the top plate, the bottom plate having recesses;

first, second, third and fourth hollow tubes at the four sides of the top plate, respectively, each hollow tube having four sides, a lower portion of each hollow tube having a width greater than an upper portion of each hollow tube;

the bottom plate having flat and horizontal areas on top of and permanently attached onto the upper portion of the first, second, third and fourth hollow tubes;

the first, second, third and fourth vertical side plates overlying the upper portion of the first, second, third and fourth hollow tubes, respectively; and an entire outer surface of each of the first, second, third and fourth vertical side plates forming first, second, third and fourth outer side surfaces of the furniture.

2. The furniture of claim 1 with the bottom plate having a first height and each hollow tube having a second height greater than the first height.

3. The furniture of claim 1 wherein each hollow tube is metal and the bottom end of each hollow tube comprises a horizontal crimped outer corner.

4. The furniture of claim 1 wherein the bottom plate has conical protrusions having flat top surfaces.

5. The furniture of claim 4 wherein the inner section of the top plate is attached to the flat top surfaces of the conical protrusions.

6. The furniture of claim 1 with the first, second, third and fourth vertical side plates having an offset bottom end contacting the lower portion of the first, second, third and fourth hollow tubes, respectively.

7. The furniture of claim 1 further including one or more vertical fasteners attaching the first, second, third and fourth hollow tubes to the bottom plate.

8. The furniture of claim 7 with the vertical fasteners extending vertically through the first, second, third and fourth hollow tubes.

9. The furniture of claim 1 further including one or more horizontal fasteners attaching the first, second, third and fourth hollow tubes to the bottom plate.

10. The furniture of claim 9 with the horizontal fasteners extending horizontally into the first, second, third and fourth hollow tubes.

11. The furniture of claim 1 wherein the flat and horizontal areas on top of the first, second, third and fourth hollow tubes are vertically spaced apart from the top plate.

12. The furniture of claim 1 wherein all portions of the vertical side plates are visible.

13. The furniture of claim 1 wherein an inside wall of each hollow tube is spaced apart from, and is not touching, the bottom plate.

14. Furniture comprising:

a top plate having a flat and horizontal inner section having first, second, third and fourth sides;

first, second, third and fourth top side plates adjoining the first, second, third and fourth sides, respectively, the top side plates perpendicular to the horizontal inner section of the top plate;

a bottom plate having projections and downward-facing recesses between the projections, the top plate attached to top surfaces of the projections;

first, second, third and fourth frame elements at the first, second, third and fourth sides of the top plate, each frame element comprising a hollow tube having four sides and an upper portion and a lower portion having a width greater than the upper portion;

the bottom plate having flat horizontal areas on top of the first, second, third and fourth hollow tubes, respectively, the flat horizontal areas vertically spaced apart from the top plate.

15. The furniture of claim 14 wherein each of the first, the second, the third and the fourth top side plate has a lower end contacting and overlying the upper portion of the first, the second, the third and the fourth frame element, respectively.

16. The furniture of claim 15 wherein each top side plate includes a portion extending at an acute angle to the inner section of the top plate.

17. The furniture of claim 14 with the projections of the bottom plate having a first height and each hollow tube having a second height greater than the first height.

18. The furniture of claim 14 wherein the top portion of each hollow tube has a height greater than the bottom portion.

19. The furniture of claim 14 wherein an entire outer surface of each of the first, second, third and fourth vertical side plates forms first, second, third and fourth outer side surfaces of the furniture, respectively.

20. The furniture of claim 14 wherein all portions of the vertical side plates are visible.

21. The furniture of claim 14 wherein an inside wall of each hollow tube is spaced apart from, and is not touching, the bottom plate.

* * * * *